United States Patent [19]

Crepinsek

[11] Patent Number: 4,474,394

[45] Date of Patent: Oct. 2, 1984

[54] REINFORCED ASSEMBLY OF STRIKE PLATE TO DOOR FRAME

[76] Inventor: Alois Crepinsek, 97 N. Arizona Pl., Chandler, Ariz. 85224

[21] Appl. No.: 411,443

[22] Filed: Aug. 25, 1982

[51] Int. Cl.[3] ..... E05C 21/02

[52] U.S. Cl. ..... 292/340

[58] Field of Search ..... 312/111; 292/340, 346

[56] References Cited

U.S. PATENT DOCUMENTS 2,639,177 5/1953 Smith ..... 292/340 X 2,943,877 7/1960 Pleterski ..... 292/340 X 3,888,530 6/1975 Fabrici ..... 292/346 X

*Primary Examiner*—Richard E. Moore

*Attorney, Agent, or Firm*—James F. Duffy

[57] ABSTRACT

A lock strike plate is coupled to a door frame by orthogonal coupling means which mate within the interior of the door frame. The orthogonal coupling means not only provide the means for mounting the strike plate to the door frame, but also reinforce the door frame itself mandating the removal of a large portion of the door frame before a forced entry through a door locked and utilizing the innovative strike plate assembly of the invention can be successful.

14 Claims, 5 Drawing Figures

REINFORCED ASSEMBLY OF STRIKE PLATE TO DOOR FRAME

BACKGROUND

1. Field of the Invention

The invention relates to the field of security locks for doors.

The invention particularly relates to the field of lock strike plate assemblies of special construction whereby installation of the strike plate to the door frame reinforces the door frame.

The invention specifically relates to the field of reinforced strike plate assemblies to which security chain latch means may be coupled for more secure operation of a security chain used in conjunction with the strike plate assembly.

2. Prior Art

A strike plate, generally manufactured of brass or steel, is mounted to a door frame and is provided with an opening through which the latch or deadbolt of a lock mounted on a door may project and be captively retained therein to secure the door in a locked position. The strike plate is generally maintained in position by two screw fasteners. An impulse of force applied to the door is often sufficient to tear the strike plate from its moorings on the door frame so as to permit the person applying such force free access to the room intended to be secured by the locked door. A maximum security strike, "strike-1." (TM), manufactured by M.A.G. Eng. and Mfg., Inc. is made of high quality 12 gauge steel and is said to add tremendous strength to a doorjamb. It is retained by four two inch and two one inch long hardened screws and is said to be many times stronger than regular strike plates. Nevertheless, the strike plate is mounted only to one side of the door frame, within the doorjamb, and relies on the additional screw fasteners for strength but contributes little to actually reinforcing the door frame itself.

In U.S. Pat. No. 4,027,907 issued to the inventor herein on June 7, 1977, a generally L-shaped strike plate is disclosed in which screw fasteners are employed on the interior surface of the door frame and on the jamb surface of the door frame to retain the L-shaped strike plate in position. The addition of screw fasteners on two orthogonal surfaces of the door frame for mounting the generally L-shaped strike assembly significantly improves the strength of the device when it is positioned on a door and used in cooperation with a door locking device.

The same patent further discloses a security chain latch housing which is pivotally coupled to the exterior surface of the generally L-shaped strike assembly. Because of the orthogonal arrangement of the screw fasteners in mounting the striker to the door frame, the associated chain latch assembly is also strengthened when compared with conventional means for affixing a chain latch to a door frame. The usual manner in which such chain latch assemblies are coupled to the door frame is by means of two threaded screw fasteners. With a door ajar and security depending upon the strength of the security chain assembly, prior art devices are prone to fail since an impact readily removes the two screw fasteners holding the prior art chain latch assembly to the door frame.

It is an objective of the present invention to overcome the disadvantages of the prior art with respect to the strength of strike plate assemblies and the mounting of security chain latch means.

It is a particular objective of the invention to provide a strike plate assembly which mounts to a door frame in such a manner as to actually reinforce the door frame and make the frame a more integral part of the securing of the door than has been hitherto available.

It is another objective of the invention to provide a reinforced strike plate assembly to which security chain latch means may be coupled in a manner so as to take advantage of the reinforced means whereby the strike plate assembly is mounted to the door frame.

SUMMARY OF THE INVENTION

The invention disclosed is a reinforced assembly of a lock strike plate in combination with a door frame having at least two orthogonal surfaces. The invention comprises strike plate means having at least two orthogonal faces for mating with two complementary orthogonal surfaces of the door frame, and further comprises orthogonal coupling means matingly coupled within the door frame for coupling the two orthogonal faces of the strike plate means to two complementary orthogonal surfaces of the door frame.

The orthogonal coupling means comprise first reinforcing means coupled to the interior of the door frame through one of the two orthogonal surfaces of the door frame, and second reinforcing means coupled to the interior of the door frame through a second one of the orthogonal surfaces of the door frame.

The first reinforcing means further comprises means for matingly coupling with the second reinforcing means within the interior of the door frame.

The first and second reinforcing means further comprise means for coupling to first and second orthogonal faces of the strike plate means so as to couple these to first and second orthogonal surfaces of the door frame respectively.

To permit the first and second reinforcing means to matingly couple within the interior of the door frame, the first reinforcing means is provided with a through hole into which the second reinforcing means is matingly introduced.

In an alternate embodiment of the invention disclosed herein, the door frame comprises a third surface which is orthogonal to the jamb surface of the door frame. The strike plate means further comprises a third face also orthogonal to the jamb surface of the door frame, and the first reinforcing means further comprises means for coupling this third face of the strike plate to the third surface of the door frame.

In either embodiment disclosed, a security chain latch means may be coupled to the first reinforcing means of the orthogonal coupling means so as to take advantage of the fact that the orthogonal coupling means are matingly coupled within the door frame and thereby strengthen the door frame itself and thus result in a greatly reinforced attachment of the security chain latch means to the door frame.

DETAILED DESCRIPTION OF THE INVENTION

Figure 1:
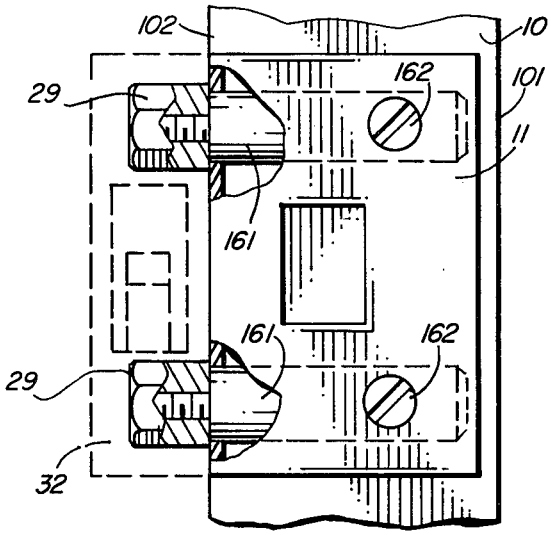
FIG. 1 is an elevation view of a strike plate assembly fastened to a door frame and illustrating in phantom outline a security chain latch means attached thereto.

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

Figure 2:
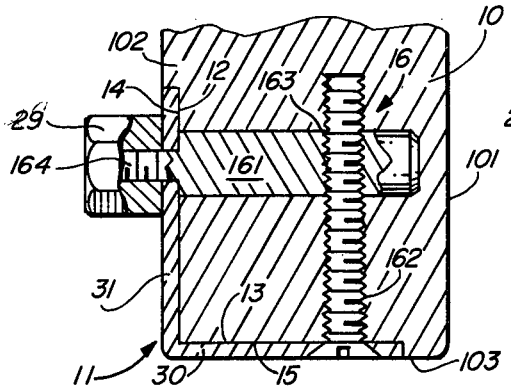
FIG. 2 is a cross-sectional plan view of the assembly of FIG. 1 showing the generally L-shaped strike plate coupled to the door frame by orthogonal coupling means which mate within the interior of the door frame itself.

In FIGS. 1 and 2 are illustrated a portion of a door frame 10 to which is affixed a generally L-shaped strike plate 11. Faces 12 and 13 of strike plate 11 mate with surfaces 14 and 15 of door frame 10.

Orthogonal coupling means 16 are employed to assemble strike plate 11 to door frame 10. Orthogonal coupling means 16 comprise a first reinforcing means 161 having a through hole 163 through which a second reinforcing means 162 is introduced.

First reinforcing means 161 is introduced into door frame 10 from the interior side 102 thereof. Reinforcing means 161 may comprise a bar or cylinder stock having a through hole 163 through which reinforcing means 162 is introduced so that the two reinforcing means 161 and 162 couple matingly within door frame 10. A threaded extension 164 of reinforcing means 161 passes through wall 31 of strike plate 11 and, in combination with cap nut 29, is employed to couple wall 31 to the interior side 102 of door frame 10 bringing the face 12 of strike plate 11 into intimate contact with door frame surface 14.

Second coupling means 162 passes through wall 30 of strike plate 11 and is matingly engaged with through hole 163 of reinforcing means 161. Reinforcing means 162 is a screw threaded fastener which threadedly engages with through hole 163. In the alternative, reinforcing means 162 may be a screw threaded fastener which threadedly engages with door frame 10 passing in close coupling proximity to the walls of through hole 163 of reinforcing means 161.

Because of the manner in which coupling means 16 mates within the interior of door frame 10, door frame 10 is reinforced and becomes a more integral part of the assembly whereby strike plate 11 is affixed to door frame 10. An attempt to force entry through a locked door utilizing strike plate 11 must of necessity result in the removal of a large portion of the door frame 10 itself in order for such forced entry to be successful.

Orthogonal coupling means 16 may be further employed to provide for reinforced mounting of a security chain latch means, illustrated in phantom as reference 32, utilizing threaded ends 164 of reinforcing means 161 and cap nuts 29 as the means for coupling the security latch means 32 to door frame 10. When a door is secured by a security chain attached to chain latch means 32 and the door is placed ajar to permit the occupant of the secured room to ascertain the identity of a person seeking entry, the full reinforced strength provided by orthogonal coupling means 16 is available for securing chain latch means 32 to door frame 10. This arrangement is far superior to the simple two screw threaded fasteners generally employed to hold a security chain latch means to door frame 10.

Figure 3:
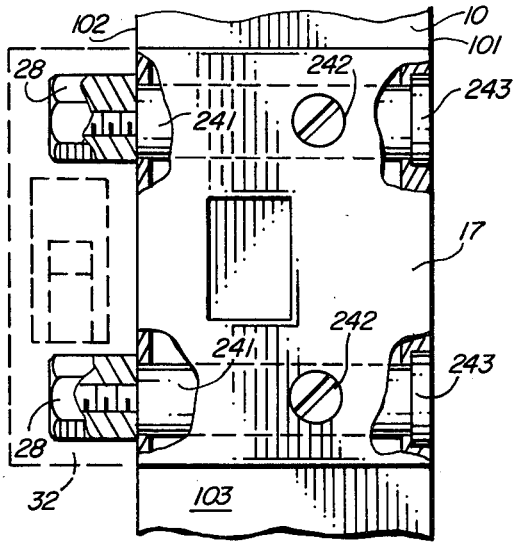
FIG. 3 is an elevation view of an alternate embodiment of the invention of a strike plate coupled to a door frame.
Figure 4:
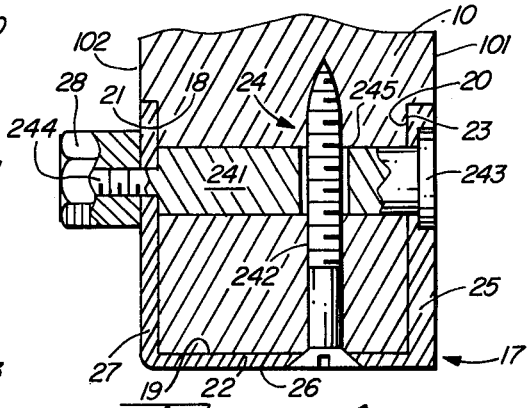
FIG. 4 is a cross-sectional plan view of the assembly of FIG. 3 illustrating the generally U-shaped strike plate assembly 7 coupled to the door frame by orthogonal coupling means which mate within the interior of the door frame itself.
Figure 5:
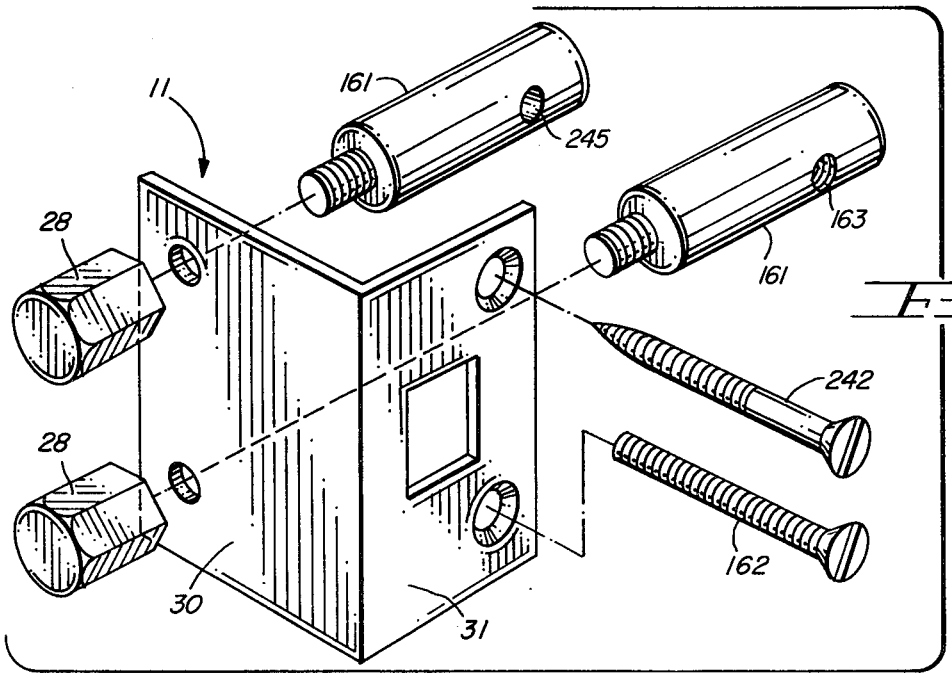
FIG. 5 is an exploded view of the assembly.

While not presently preferred, an alternate embodiment of a reinforced strike plate 17 is illustrated in FIGS. 3 and 4. Strike plate 17 is generally U-shaped in cross-section. The innerfaces 18, 19 and 20 of strike plate 17 mate with surfaces 21, 22 and 23, respectively, of door frame 10. Thus, strike plate 17 encompasses portions of the exterior side 101 of door frame 10 as well as the jamb side 103 and a portion of the interior side 102.

Similar to the orthogonal coupling means 16 already described, orthogonal coupling means 24, which mate within the interior of door frame 10, are employed in affixing strike plate 17 to door frame 10. First reinforcing means 241 passes through wall 25 of strike plate 17 into door frame 10. An enlarged head 243 of reinforcing means 241 is countersunk within wall 25 of strike plate 17. A through hole 245 is provided within reinforcing means 241 to matingly engage with second reinforcing means 242. As before, reinforcing means 242 may be a screw threaded fastener which engages threadedly with either reinforcing means 241 as it passes through through hole 245 or with door frame 10 itself.

Reinforcing means 241 is provided with a screw threaded end 244 which passes through wall 27 of strike plate 17 and, in combination with cap nut 28, fixedly couples strike plate 17 to door frame 10. Second reinforcing means 242, passing through wall 26 of strike plate 17, fixedly couples face 19 of strike plate 17 to surface 22 of door frame 10. This mounting arrangement assures fixed intimate contact of the faces 18, 19 and 20 of strike plate 17 with surfaces 21, 22 and 23, respectively, of door frame 10.

In the manner earlier disclosed, the mating of orthogonal coupling means 24 within the interior of door frame 10 reinforces door frame 10 and makes it a more integral part of the overall assembly such that the removal of a significant portion of the door frame itself is necessitated in attempting a forced entry through a door locked and utilizing strike plate 17.

As mentioned with respect to the generally L-shaped strike plate 11, a security chain latch means 32, shown in phantom outline in FIG. 3, may be coupled to door frame 10 utilizing threaded end portion 244 of reinforcing means 241 and cap nuts 28. Once again, the inherent improved reinforcement provided by orthogonal coupling means 24 greatly reinforces and strengthens the coupling of security chain latch means 32 to door frame 10.

What has been disclosed is a lock strike plate which is coupled to a door frame by orthogonal coupling means which mate within the interior of the door frame. The orthogonal coupling means not only provide the means for mounting the strike plate to the door frame, but also reinforce the door frame itself mandating the removal of a large portion of the door frame before a forced entry through a door locked and utilizing the innovative strike plate assembly of the invention can be successful.

Those skilled in the art will readily conceive of other embodiments of the invention which may be drawn from the teachings herein. To the extent that such alternate embodiments are so drawn, it is intended that they shall fall within the ambit of protection provided by the claims appended hereto.

Having described my invention in the foregoing specification and the accompanying drawings in such a clear and concise manner that those skilled in the art may readily understand and practice the invention, that which I claim is:

1. In combination with a door frame having at least two orthogonal surfaces a reinforced assembly of a lock strike plate to said door frame comprising:

strike plate means having at least two orthogonal faces for mating with two complementary orthogonal surfaces of said door frame; and orthogonal coupling means matingly coupled within said door frame for coupling said at least two orthogonal faces of said strike plate means to two complementary orthogonal surfaces of said door frame.

2. The reinforced assembly of claim 1 wherein said orthogonal coupling means comprises first reinforcing means coupled to the interior of said door frame through a first one of said at least two orthogonal surfaces of said door frame.

3. The reinforced assembly of claim 2 wherein said orthogonal coupling means further comprises second reinforcing means coupled to the interior of said door frame through a second one of said at least two orthogonal surfaces of said door frame.

4. The reinforced assembly of claim 3 wherein said first reinforcing means further comprises means for matingly coupling with said second reinforcing means within the interior of said door frame.

5. The reinforced assembly of claim 4 wherein said first reinforcing means further comprises means for coupling a first of said at least two orthogonal faces of said strike plate means to said first one of said at least two orthogonal surfaces of said door frame.

6. The reinforced assembly of claim 5 wherein said means for coupling a first of said at least two orthogonal faces of said strike plate means to said first one of said at least two orthogonal surfaces of said door frame further comprises means for coupling security chain latch means thereto.

7. The reinforced assembly of claim 5 wherein said second reinforcing means further comprises means for coupling a second of said at least two orthogonal faces of said strike plate means to said second one of said at least two orthogonal surfaces of said door frame.

8. The reinforced assembly of claim 7 wherein:

said first reinforcing means comprises reinforcing bar means; and said means for matingly coupling with said second reinforcing means comprises a through hole in said reinforcing bar means into which said second reinforcing means is matingly introduced.

9. The reinforced assembly of claim 8 wherein said second reinforcing means comprises a screw threaded fastener threadedly engaged with said door frame and passing through said through hole in said first reinforcing means to matingly engage therewith.

10. The reinforced assembly of claim 8 wherein said second reinforcing means comprises a screw threaded fastener passing through said door frame and threadedly engaged with said through hole in said first reinforcing means to matingly engage therewith.

11. The reinforced assembly of claim 9 or 10 wherein said means for coupling a first of said at least two orthogonal faces of said strike plate means to said first one of said at least two orthogonal surfaces of said door frame further comprises means for coupling security chain latch means thereto.

12. The reinforced assembly of claim 8 wherein:

said door frame further comprises a third surface orthogonal to said second one of said at least two orthogonal surfaces of said door frame; and said strike plate means further comprises a third face orthogonal to said second of at least two orthogonal faces of said strike plate means.

13. The reinforced assembly of claim 12 wherein said first reinforcing means further comprises means for coupling said third face of said strike plate means to said third surface of said door frame.

14. The reinforced assembly of claim 13 wherein said means for coupling a first of said at least two orthogonal faces of said strike plate means to said first one of said at least two orthogonal surfaces of said door frame further comprises means for coupling security chain latch means thereto.

* * * * *